US006681527B2

(12) United States Patent
Baker

(10) Patent No.: US 6,681,527 B2
(45) Date of Patent: Jan. 27, 2004

(54) GUTTER PROTECTION SYSTEM

(75) Inventor: Michael J. Baker, Richmond, VA (US)

(73) Assignee: Joco Products LLC, Richmond, VA (US)

( * ) Notice: Subject to any disclaimer, the term of this patent is extended or adjusted under 35 U.S.C. 154(b) by 81 days.

(21) Appl. No.: 10/011,332

(22) Filed: Dec. 5, 2001

(65) Prior Publication Data

US 2002/0073631 A1 Jun. 20, 2002

Related U.S. Application Data

(60) Provisional application No. 60/254,160, filed on Dec. 11, 2000.

(51) Int. Cl.[7] ..... E04D 13/00
(52) U.S. Cl. ..... 52/12; 52/11; 52/15
(58) Field of Search ..... 52/11, 12, 15

(56) References Cited

U.S. PATENT DOCUMENTS 2,209,741 A 7/1940 Sullivan et al.
2,672,832 A * 3/1954 Goetz ..... 52/12
3,416,760 A * 12/1968 Sauder ..... 248/48.2
3,550,381 A 12/1970 South (List continued on next page.)

OTHER PUBLICATIONS

K–Guard, LLC, K Guard Leaf Free Gutter System brochure.
Raytec Manufacturing, HangFast Gutter Hanger brochure.
Englert Leaf, Englert Leaf Guard brochure.
Spectra Metal Sales, Inc., Gutter Cap brochure, 1998.
Eran Industries, Leafproof brochure, 1997.
American Metal Products, Gutter Helmet of Virginia brochure, 1997.
The Wall–Fill Company, Leaf–it–Alone Gutter Protector brochure, 1998.
Guttertopper Ltd., Gutter Topper Ltd brochure, 1999.
Gutterpro USA, Gutter Pro USA Systems.

*Primary Examiner*—Carl D. Friedman
*Assistant Examiner*—Basil Katcheves
(74) *Attorney, Agent, or Firm*—Michael N. Haynes

(57) ABSTRACT

A gutter protection system for diverting debris and collecting water in a trough of a gutter connected to a building structure is disclosed. The gutter protection system can include a cap that can be positionally fixed in place at a predetermined angle of inclination above the gutter by a support member or bracket. The bracket can be supported by and connected to a hanger that connects the gutter to the building structure. The cap can be spaced apart from the building structure, including a roof of the building structure.

44 Claims, 10 Drawing Sheets

U.S. PATENT DOCUMENTS

| | | | | | |
|---|---|---|---|---|---|
| 3,874,131 | A | * | 4/1975 | Webster | 52/11 |
| 3,915,418 | A | | 10/1975 | D'Amato | |
| 3,950,951 | A | | 4/1976 | Zukauskas | |
| 4,497,146 | A | | 2/1985 | Demartini | |
| 4,580,661 | A | | 4/1986 | Thomson, Jr. | |
| 4,604,837 | A | | 8/1986 | Beam | |
| 4,616,450 | A | | 10/1986 | Shouse | |
| 4,866,890 | A | * | 9/1989 | Otto | 52/12 |
| 5,040,750 | A | * | 8/1991 | Brant | 248/48.2 |
| 5,072,551 | A | * | 12/1991 | Manoogian, Jr. | 52/12 |
| 5,271,192 | A | | 12/1993 | Nothum, Sr. et al. | |
| 5,388,377 | A | * | 2/1995 | Faulkner | 52/11 |
| 5,457,916 | A | | 10/1995 | Tenute | |
| 5,491,998 | A | | 2/1996 | Hansen | |
| 5,537,785 | A | | 7/1996 | Zaccagni | |
| 5,557,891 | A | | 9/1996 | Albracht | |
| 5,592,783 | A | | 1/1997 | Jones | |
| 5,617,678 | A | * | 4/1997 | Morandin et al. | 52/11 |
| 5,619,825 | A | | 4/1997 | Leroney et al. | |
| 5,819,476 | A | | 10/1998 | Annestedt, Sr. | |
| 5,842,311 | A | | 12/1998 | Morin | |
| 5,845,435 | A | | 12/1998 | Knudson | |
| 5,848,857 | A | | 12/1998 | Killworth | |
| 5,893,240 | A | | 4/1999 | Ealer, Sr. | |
| 5,911,659 | A | | 6/1999 | Serano | |
| 5,956,904 | A | | 9/1999 | Gentry | |
| D416,079 | S | | 11/1999 | Hallett | |
| 6,016,631 | A | | 1/2000 | Lowrie, III | |
| 6,047,502 | A | | 4/2000 | Kimmitt et al. | |
| 6,073,398 | A | | 6/2000 | Williams | |
| 6,098,344 | A | | 8/2000 | Albracht | |
| 6,098,345 | A | | 8/2000 | Demartini et al. | |
| 6,205,715 | B1 | * | 3/2001 | Rex, Jr. | 52/12 |

* cited by examiner

GUTTER PROTECTION SYSTEM

CROSS-REFERENCE TO RELATED APPLICATION

This application claims priority to, and incorporates herein by reference in its entirety, pending United States provisional application Ser. No. 60/254,160, (Attorney Docket No. 08990-001), filed Dec. 11, 2000.

FIELD OF THE INVENTION

The present invention relates to the field of gutter systems, and more particularly, to a device, system, and method for diverting debris from a gutter system.

BRIEF DESCRIPTION OF THE DRAWINGS

This invention may be understood from the description that follows and from the attached drawings in which.

DETAILED DESCRIPTION

Figure 1:
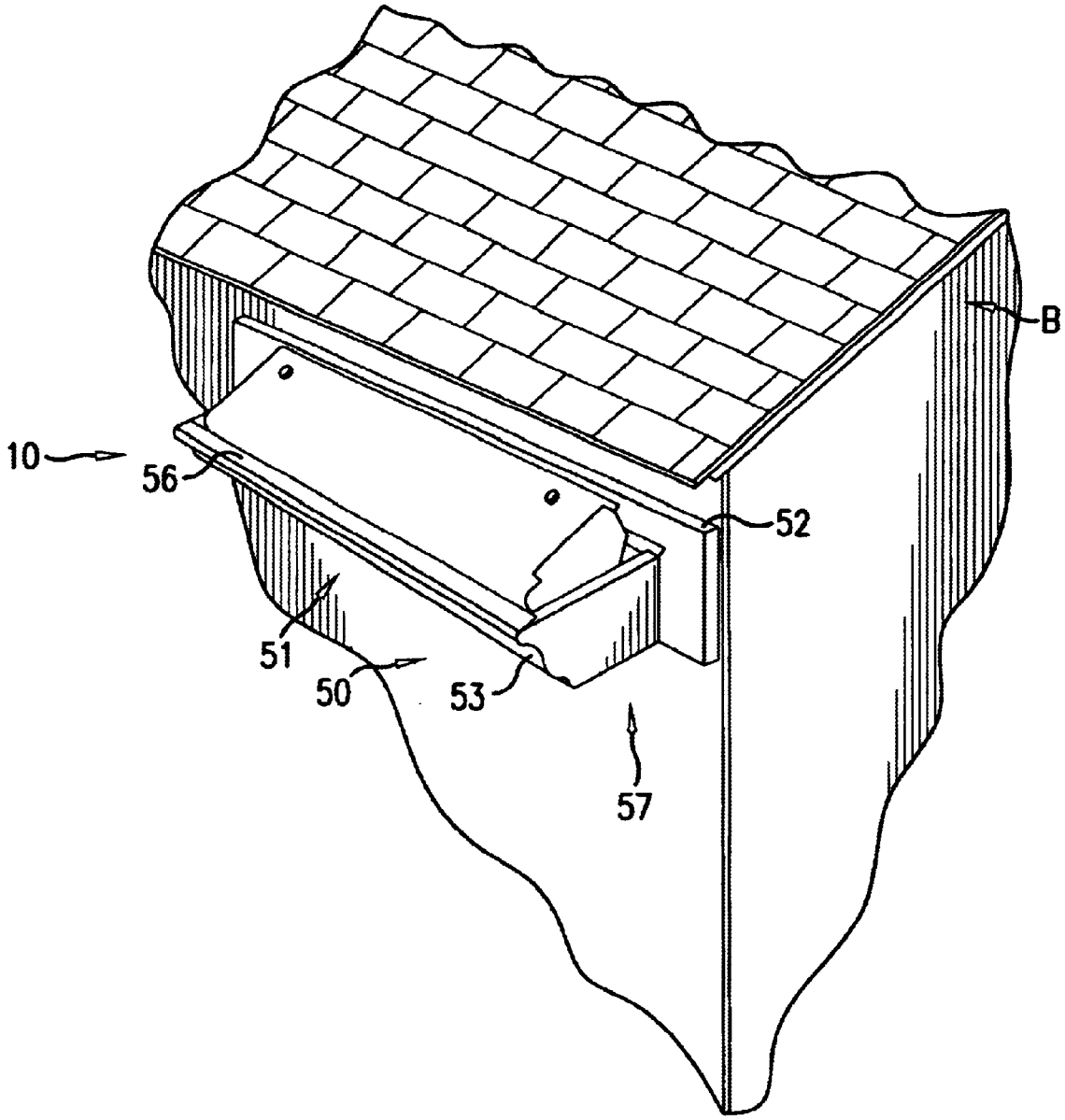
FIG. 1 is a perspective view of one embodiment of a gutter protection system according to the present invention installed in a conventional gutter system on a building structure.

In buildings such as dwelling houses and other structures it is desirable to divert water and debris from the roof away from the base of the structure using gutter systems. The gutters of such gutter systems are attached to the roofline of the structure to divert rainwater into downspouts. A common problem with such gutter systems is the accumulation of debris such as leaves and twigs, that block the flow of water in the gutter or the downspout. Such blockage associated with gutter systems prevents proper evacuation of water and/or debris and creates problems that necessitate periodic cleaning and maintenance. Such cleaning and maintenance of gutters, particularly at the roofline, is a difficult and inconvenient activity.

Prior efforts help to provide gutter systems that prevent blockage and accumulation of debris have resulted in various devices and mechanisms attached to building structures and roofs to prevent these materials from falling inside the gutter. For example, solid deflectors or caps have been placed on top of the gutter body or connected to the building structure by piercing the gutter body or structure with fasteners such as nails, often resulting in damage to the structure and roof, or leakage in the gutters. Further, deflectors or caps have been positioned above gutters and connected to the roofing by fasteners, often in a process requiring raising the roofing, which can provide access to the roof board for water and result in water damage. Still other systems have utilized caps or shields that are clipped onto the front lip or edge of the gutter to be retained in position.

One known gutter protection system includes a deflector attached to a gutter support system and to the roofing or shingles. The gutter body is affixed to the structure by a nail of the gutter support system. Inside the gutter, the nail is surrounded by a ferrule (a cylindrical metal tube). The gutter rain deflector of this known system is positioned above the roofline and extends away from the house beyond the outer edge of the gutter body.

Another type of gutter protector is one that uses open mesh screens or grids which are positioned to rest on the body of the gutter and which are held in place by various fasteners. For example, one known system utilizes a mesh screen placed over the gutter opening and biased in place with a lip of the screen positioned under the front lip of the gutter. Such systems do not facilitate run-off of debris, and instead allow small debris, such as pine needles, to readily enter and clog the screen-holes. Further, such biased systems do not remain firmly in place and can be dislodged by wind, rain, or animals.

Certain gutter systems are attached to structures with a hanger positioned within the gutter body and attached to the front lip of the gutter body. Such a hanger is commonly referred to as a hidden hanger. These hidden hangers are typically elongated members having a lip at a first end that attaches to the front of the gutter body. They also have a second end that fastens to the rear wall of the gutter body and to the building structure via a nail or other fastener that pierces the wall of the gutter and the structure.

Certain gutter protection devices are difficult to connect to existing gutter structures or do not remain in place when subjected to wind, rain, or animals. Thus, there exists a need for a gutter protection system or rain deflector that could be easily and fixedly attached to existing gutter structures, including those attached with hidden hangers. Moreover, existing gutter protection systems are not designed to be used with such hidden hangers, but instead require connection to the roofing and front edge of the gutter. Thus, there remains a need for a gutter protection system that is easily attached to existing gutter systems such as those utilizing hidden hangers without damaging the gutter, roofing, or building structure.

Embodiments of the present invention can provide a gutter protection system that easily attaches to a gutter hanger and is supported solely by the gutter hanger while diverting debris away from and receiving rain into the gutter. Further, embodiments of the present invention can provide a gutter protection system structured for use with a rain gutter of established design and construction without the need of being affixed to or supported by the shingles or roof. Moreover, embodiments of the invention can provide a gutter protection system that can be retrofitted to existing gutter systems without requiring removal of the gutters from the structure, or alternatively, can be attached to the gutter prior to or during the attachment of the gutter to the structure.

To overcome the needs and shortcomings of certain known gutter protection systems, embodiments of the present invention can provide an improved gutter protection system for diverting debris from and collecting water in a gutter trough that extends along the length of the gutter. Certain embodiments of the gutter protection system can include at least one support member or bracket seated on a hidden hanger that is connected with the gutter and the building structure to which the gutter is mounted, and a cap or deflector that is preferably connected with and supported solely by the support member or bracket. The support member can positionally fix the cap above the trough of the gutter at a predetermined angle of inclination. Certain embodiments of the present invention are preferably adapted for disposition below a terminal edge of a roof of a building structure without requiring insertion under or connection with roof coverings or shingles.

Certain embodiments of the gutter protection system of the present invention are adapted for use in association with any conventional type of gutter system. The gutter protection system can be retrofitted to previously attached gutters or, alternatively, attached to the gutter during the installation of the gutters on the structure.

In one embodiment, the gutter protection system of the present invention is a gutter protection system for diverting debris from and collecting water in a gutter trough that extends along the length of the gutter. The gutter is of the type that is connected with the roofline of a building structure by a gutter hanger. The gutter hanger is of the type that is commonly connected to a front lip of the gutter and extending transversely across the width of the trough to the structure and referred to as a hidden hanger.

In this first embodiment, the gutter protection system of the present invention comprises a support member having a seat and at least one arm extending from the seat at an angle from the seat. The bracket is adapted to be positioned on the gutter hanger. The gutter protection system further comprises a cap connected to at least one arm of the bracket. The cap extends along the arm in a first direction defining the width of the cap and laterally away from the arm on opposite sides in a second direction defining the length of the cap. The gutter protection system further comprises affixing means for affixing the support member to the hanger.

In this embodiment of a gutter protection system of the present invention, the support member is adapted to positionally fix the cap above the trough such that the cap extends in its first direction above the width of the trough at a predetermined angle from the seat and the cap is spaced apart from the roofline of the structure. Preferably, at least one arm further comprises a plurality of spaced apart arms, and more preferably a pair of spaced apart arms.

Additionally, the cap is preferably positionally fixed at a predetermined angle approximating the angle of the roofline of the structure. In one embodiment, at least one arm extends from the seat such that the support member is adapted to be affixed to the hanger with the distal end of the arm spaced apart from the building structure. The cap is also juxtaposed above and coextensively extends along the length of at least one arm such that the cap and the arm extend from the base at approximately the same angle of inclination. Still further, the support member, in this embodiment, further comprises at least two lateral wings extending downwardly on opposite sides of the seat. The bracket is adapted to be positioned on the hanger such that the wings contact opposite sides of the hanger to secure the support member in a fixed position with respect to the hanger. The bracket further preferably comprises an arcuate body portion between the arms and the seat, and the cap further comprises an arcuate lip portion at a forward end of its width. The arcuate lip portion of the cap coextensively envelopes the arcuate body portion of the bracket. The arcuate lip portion is configured to utilize the surface tension of rainwater to direct the rainwater along the lip into the trough. In additional embodiments, the support and cap can be integrally constructed from a single piece or provided with configurations.

Embodiments of the present invention will now be described more fully, with reference to the accompanying figures. This invention may, however, be embodied in many different forms and should not be construed as limited to the embodiments set forth herein. With regard to the figures, the term frontward or front refers to the elements positioned, or spaced apart distally from the building structure and roof, and the term rearward refers to the portion of these items that are proximate to the building structure.

In an exemplary embodiment, as shown in FIGS. 1–4, the gutter protection system 10 comprises a solid, continuous, smooth, andlor uninterrupted cover member or cap 15 and a support member in the form of seating bracket 25. Gutter protection system 10 can be connected to existing gutter system 50 via bracket 25.

For the purpose of orientation and description, existing gutter system 50 is shown in FIG. 1 to include gutter body 51 that is connected generally along and parallel to the roofline of the structure of building B to which it is attached. Gutter body 51 has a rear wall 52 that is positioned against building B and front wall 53 with lip 56 set apart opposite to rear wall 64. Gutter body 51 also has a bottom portion 57 between rear wall 64 and front wall 53. Rear wall 64, front wall 53, and bottom portion 57 define trough 54 as shown in FIG. 2.

Figure 2:
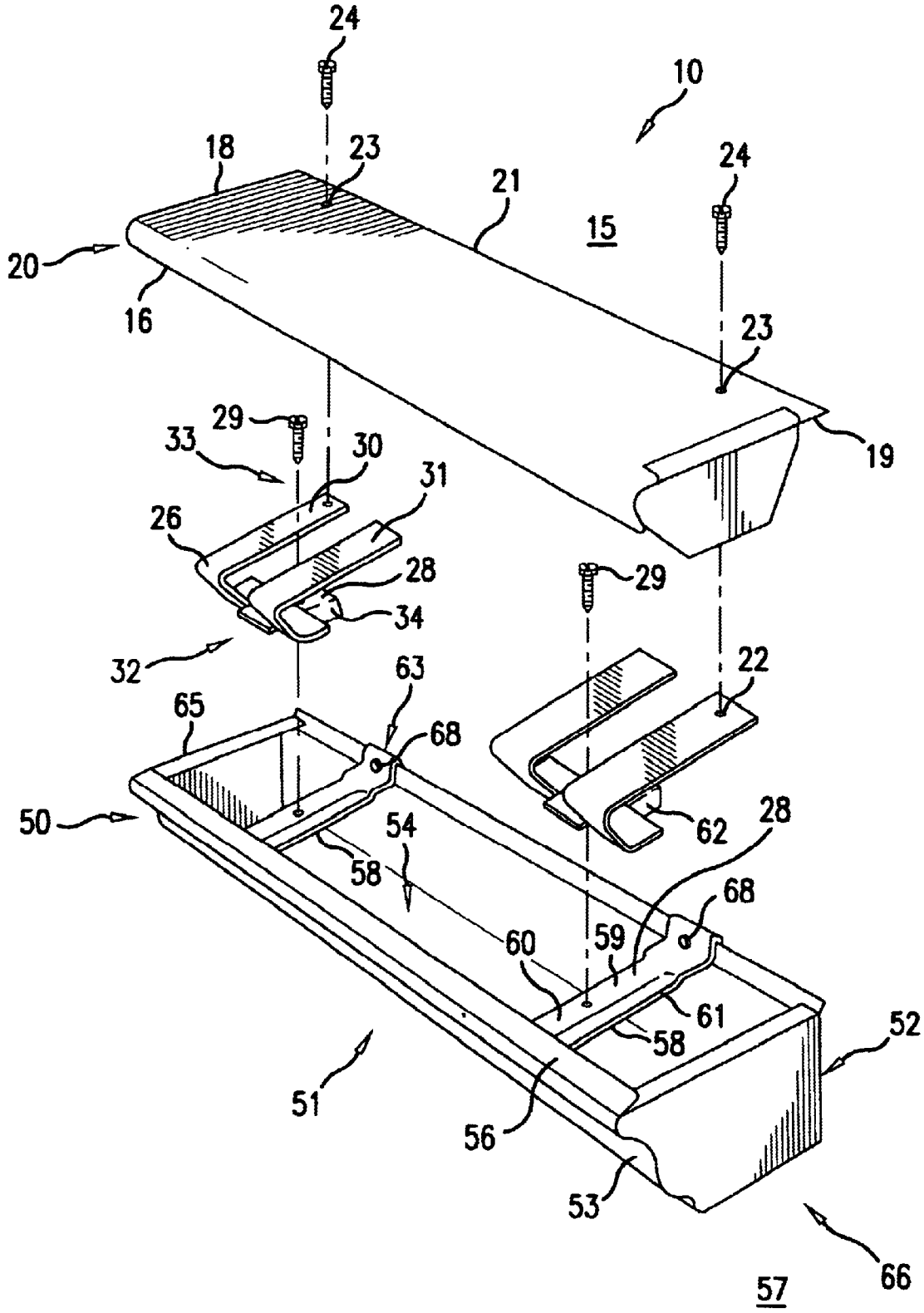
FIG. 2 is an exploded perspective of an embodiment of the gutter protection system including a support member seated above a hidden hanger and a gutter cap positioned above the bracket.
Figure 3:
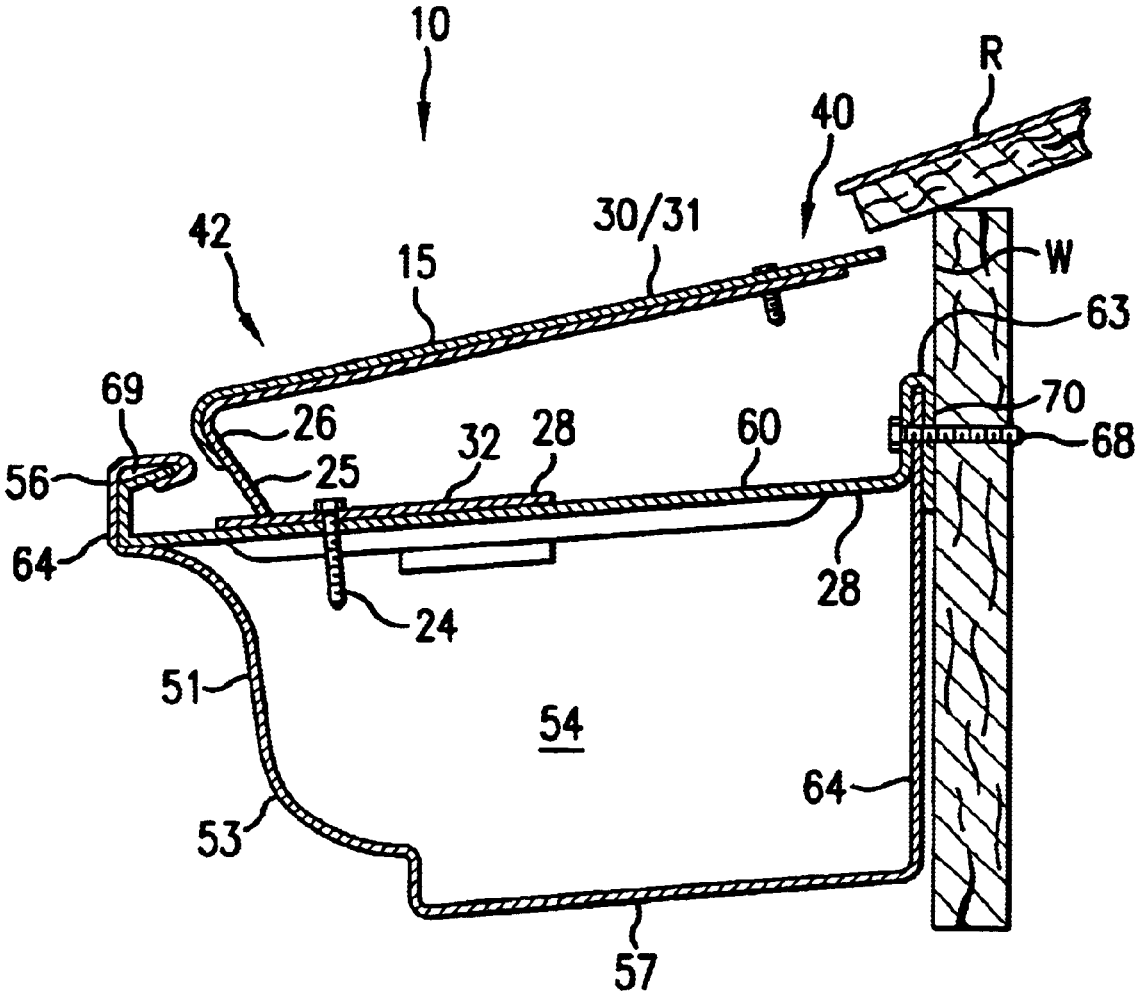
FIG. 3 is a cross-sectional view of an embodiment of a gutter protection system mounted to a gutter system.
Figure 4:
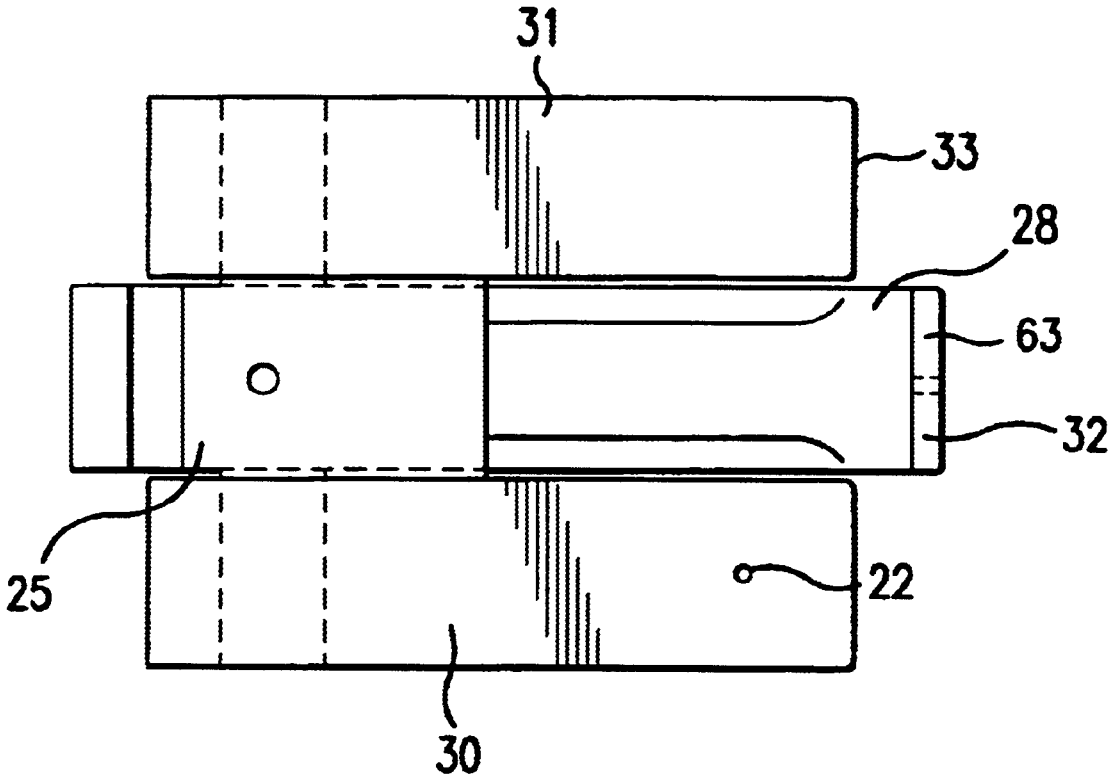
FIG. 4 is a top view of double wing support member of an embodiment of the gutter protection system seated on the hidden hanger.

Existing gutter body 51 can be connected to a building B with a gutter hanger or hidden hanger 58 (shown in FIGS. 2 and 3). Hanger 58 can have an elongated body 59 with an upper side 60, side flanges 61 and 62, a rearward end portion 63, and a frontward end 64 opposite the rearward end portion 63. Hanger 58 can be formed of aluminum, but can be provided in alternative embodiments and other materials including galvanized steel, or other weather resistant materials.

As shown on FIG. 2, hidden hanger 58 can be positioned inside gutter trough 54. Rearward end portion 63 can be connected to building structure B by an attachment means such as a screw or fastener 68. Frontward end 64 of hidden hanger 58 can have a curved portion 69 as shown in FIG. 3 that can extend under lip portion 56 of gutter body 51. Rearward end portion 63 can be curvingly curled upwardly and rearwardly to form butt portion 70 that can be positioned against the rear wall for connection by the screw or fastener 68. Side flanges 61 and 62 of hidden hanger 58 can form a platform onto which gutter protection system 10 can be supported.

It is understood that the gutter protection system of the present invention may be utilized, in alternative embodiments, with gutter systems having bodies and attachment devices having varying configurations.

Thus, the existing gutter system having been described, the gutter protection system 10 will be more fully described. In the embodiment described in FIGS. 1–4, the gutter protection system 10 includes a cover member or cap 15 and a support member or seating bracket 25. The seating bracket 25 is adapted to be connected to the hidden hanger 58.

As shown in FIGS. 2 and 3, the seating bracket 25 has a first end 32 including a seat or base portion 28 that is adapted to be position on the hanger 58 by a fastener shown as screw 29. In alternate embodiments, the mechanical fasteners, or chemical fasteners including adhesives or even electromagnetic fasteners in combination with mechanical or chemical fasteners can be provided. The seating bracket 25 further has a second end 33 including a pair of arms 30 and 31 extending from the seat 28 at a predetermined angle and as shown in FIG. 2. The arms 30 and 31 are parallel to and spaced apart from each other. Each arm 30 and 31 is configured to be fastened to the underside 16 of the cover member 15 to support the cover member 15 above the trough 54.

The second end 33 is attached to gutter hanger 58 via fastening means depicted as a screw or fastener 24. It is understood that other connectors and fasteners of various designs and configurations including mechanical connectors, adhesives and other chemical fasteners and even magnetic fasteners can be utilized. The seating bracket 25 also includes an arcuate body portion 26 that extends between the two arms 30 and 31 and the seat portion 28. The support member 25 is constructed of aluminum, but can be provided in alternative embodiments of other suitable weather-resistant materials having desired surface characteristics to facilitate flow of water or debris including polymers, galvanized steel, copper, or other weather resistant material.

Figure 5:
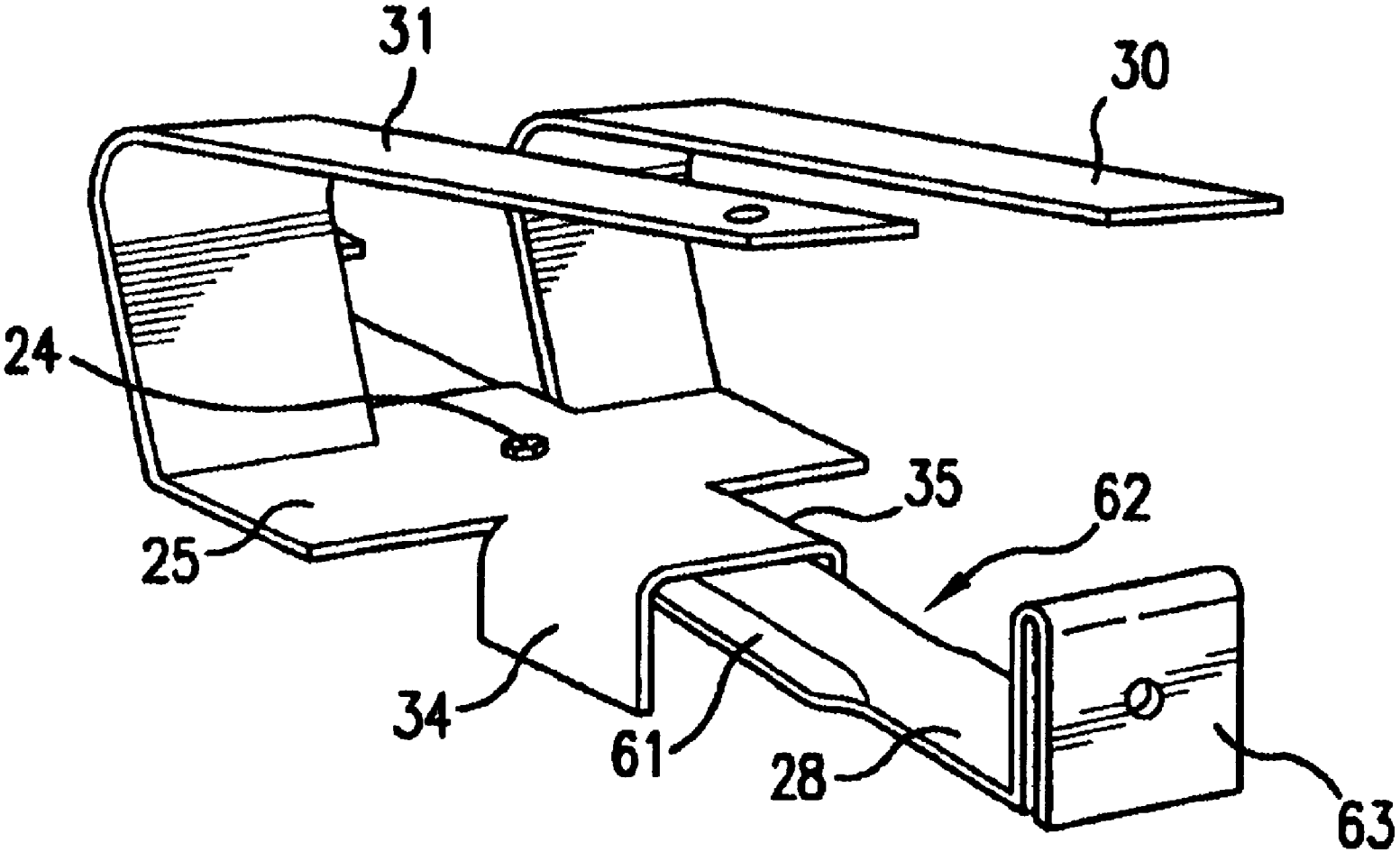
FIG. 5 is a perspective back view of double wing bracket of an embodiment of the gutter protection system seated on the hidden hanger.

The first end 32 of the seating bracket 25 can be provided in alternative embodiments with a single or further plurality of arms. The arms may be provided in various configurations and alignments to attach to the cover member. As shown on FIG. 5, the bracket wings 34 and 35 are configured to such that when the seating bracket 25 is positioned on the hanger 58, the bracket wings 34 and 35 contact opposite side flanges 61 and 62 of the hanger 58 to secure the seating bracket 25 in a fixed position with respect to the hanger 58 (see FIG. 1).

The present invention comprises a cover member 15 fastened to the seating bracket 25 with self tapping screws or screws 24 that extend through threaded holes 23 in the cover member 15 that are positioned in the cover member 15 such that when the cover member 15 is attached to the bracket 25, the hole 23 of the cover member 15 aligns with the corresponding threaded hole 22 in the seating bracket 25 providing a threaded opening for screw 24. In alternative embodiments, the cover member 15 can be attached to the bracket 25 utilizing other mechanical fasteners such as nuts and bolts, snap or press-fit connectors of various types including by way of example, clips, chemical fasteners or adhesives or magnetic connectors in combination with mechanical or chemical connectors.

The cover member 15 is constructed of aluminum, but can be provided in alternative embodiments of other suitable weather-resistant materials having desired surface characteristics to facilitate flow of water or debris including polymers, galvanized steel or copper. The cover member 15 is connected to the arms 30 and 31 of the seating bracket 25 in a manner such that the cover member 15 extends along each of the arms 30 and 31 in a first direction to a pair of edges 20 and 21 self tapping screw defining the width of the cover member 15 and laterally away from the arm on opposite sides in a second direction to edges 18 and 19 defining the length of the cover member 15. The cover member can be provided in sections of any desired length. The cover member 15 is juxtaposed above and coextensively along the length of the arms 30 and 31 such that the cover member 15 and the arms 30 and 31 extend from the seat 28 at approximately the same angle of inclination as shown in FIG. 3.

The cover member 15 is thus secured without fastening or connecting to the gutter body 51 or the building B. The seat 28 is adapted to connect the seating bracket 25 to the gutter hanger 58, thereby seating the bracket 25 and cover member 15 above the gutter trough 54. The cap 15 has an arcuate lip portion 14 that is configured to utilize the surface tension of rainwater to direct the rainwater into the trough 54. The edge 18 and edge 19 of the length of the cover member 15 are positioned to extend to end 65 and end 66 of the length of the gutter body member. The hidden hanger 58 of the seating bracket 25 can be provided in alternative embodiments with a single or plurality of arms. FIG. 3 depicts the cover 15 being positioned adjacent and below the lower edge of the roof R. While depicted in FIG. 3 as being attached to a building B with a roof having predetermined pitch, the gutter protection system 10 can be is affixed to buildings with any type of building roof including tin, slate, cedar roof, concrete or other tiles or asphalt or other singles because the gutter protection system does not require attachment to the roofing material. Further, as the cover member 15 can be provided fixedly positioned at various desired predetermined angles of inclination, the gutter protection system 10 can be provided to be utilized with building having roofs regardless of the roof pitch. The cover member 15 preferably has a width that is preferably less than the width of the trough 54 such that the cover member 15 is thereby supported in covering relation over the open top of the gutter body 51 with lip portion 14 extending along the front wall 53 of the gutter body 51. In this disposition, the cover member 15 is oriented at a slight downward incline from its rearward region 40 to its forward region 42. The rearward region 42 of the cover member 15 is not in contact with the building. The cover member 15 directs, with the assistance of surface tension, water into the gutter while the leaves, debris, and the like are deflected and/or jettisoned over the edge. The cover member 15 is at an angle of inclination that is approximate the roof angle of inclination. However, the cover member can be mounted at any of a variety of predetermined and/or adjustable angles. The present invention thus provides a gutter protection system that diverts debris from entry to the trough, but which still diverts water into the trough. The gutter protection system can be easily connected to existing gutter installations.

The gutter protection system 10 of this embodiment of the present invention can be attached to an existing gutter system 50 that has been previously attached to a building structure B. The fully assembled gutter protection system 10 is shown attached to the building B and gutter system 50 in FIG. 1. FIG. 2 shows the steps of attaching the gutter protection system 10 to the gutter system 50 including the gutter body 51 and hangers 58 previously connected to a building structure. The support member 25 is positioned on the hanger 58 as described above and connected to hanger 58 as described previously and connected to the hanger 58 by screw 29. A support member 25 is connected to each hanger 58, although the gutter protection system 10 can be utilized without connecting a bracket 25 to every hanger 58 if desired.

The cover member 15 is also positioned on the bracket 25 as desired and described herein and connected to the support member 25 by screw 24. Thus, the gutter protection system 10 can be connected to an existing gutter without necessitating the removal of the gutter from the structure. Alternatively, the gutter protection system of the present invention can be installed during the installation of the gutter system. In this way, the support member 25 can be attached to the hidden hanger 58 either prior to attaching the hanger 58 to the gutter body 51 and building or after such connection of the hanger is made. This flexibility increases the ease of connection of the gutter protection system whether connecting to a pre-existing gutter system or during the installation of the gutter system on the structure.

Figure 6:
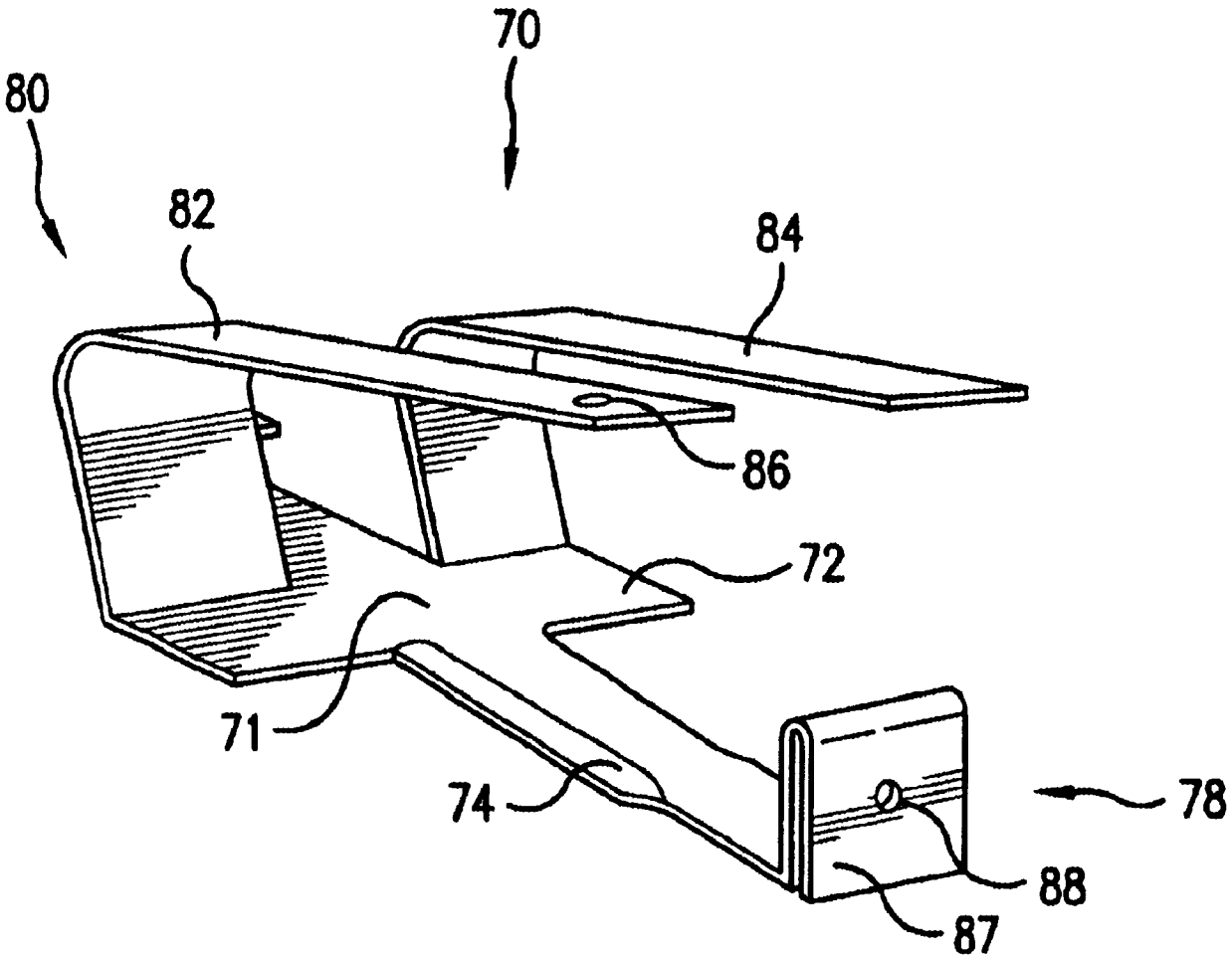
FIG. 6 is a perspective back view of an embodiment of the gutter protection system having the support member and hidden hanger integrally formed in a unitary construction.

In a second embodiment of the gutter protection system 110 of the present invention, the seating brackets 25 and the hidden hanger 58 of the previous embodiment are provided in an integral construction as a single hanger support device 70. The support hanger device 70 is adapted and configured to connect to the gutter system 50. The bracket-hanger device 70 has an elongated seat 71 with an upper side 72, side flanges 74 and 76. The seat 71 extends from a rearward end portion 78, to a frontward end portion 80. The hanger-support 70 also includes an arcuate body 73 located the frontward end 80 that extends from the seat 71 at a predetermined angle. The hanger support 70 further includes a pair of arms 82 and 84 extending from the arcuate body 73 at a predetermined angle as shown on FIG. 6. The arms 82 and 84 are parallel and spaced apart from each other. The arms 82 or 84 are configured to extend coextensively with the underside 16 of the cover member 15 to support said cover member 15 above trough 54. One of the arms 82 includes a hole 86 for receiving a screw or other fastener (not shown) to connect he cover member 15 to the arm 82. The rearward end portion 78 of the bracket-hanger device has a lip portion 87. This second embodiment of the invention comprises a cover member 15 substantially of the same construction as that described with respect to the embodiment in FIGS. 1–5. The cover member 15 is connected to the arms 82 and 84 of the bracket-hanger device 70 in a like manner to that described with respect to the embodiment of the gutter protection system 10 described in FIGS. 1–5 such that the cover member 15 extends along each of the arms 82 and 84 in a first direction to a pair of edges 65 and 66 defining the width of the cover member and laterally away from the arm on opposite sides in a second direction to edges 18 and 19 defining the length of the cover member. The cover member 15 is juxtaposed above and coextensively along the length of the arms 82 and 84 such as the cover member 15 and the arms extend from the lip portion 86 at approximately the same angle of inclination. The lip portion 87 of the bracket-hanger device 68 is adapted to fit at the top of the rear wall 64 of the gutter body 51. A screw (not shown) extending through hole 88 maintains the rearward end portion 78 of bracket-hanger device 68 securely against the structure building B. The bracket hanger device 70 is formed of the same materials as that described with reference to the first embodiment.

Figure 8:
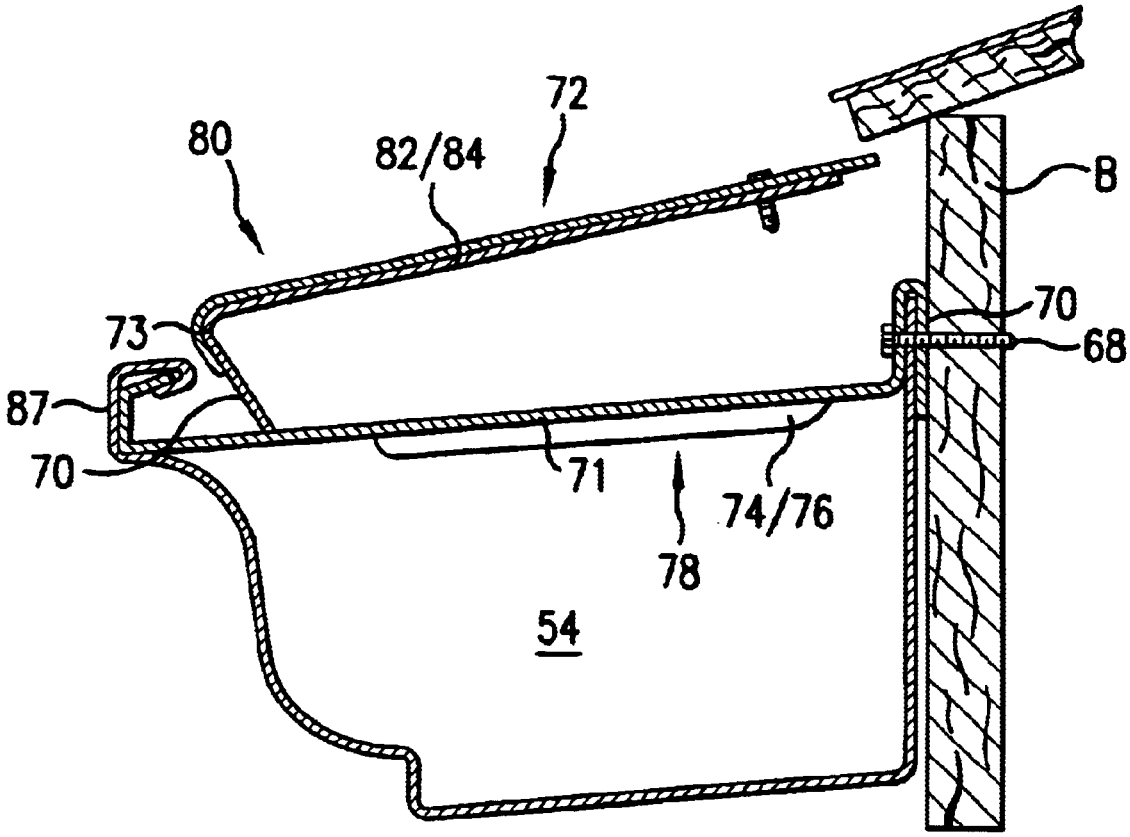
FIG. 8 is a cross-sectional view of an embodiment of the gutter protection system mounted to a gutter system.

As shown in FIG. 8, the bracket hanger device 70 is positioned inside the standard gutter trough 54. The rearward portion 78 is connected to the building structure B by an attachment means such as a screw or fastener 68. The frontward end 80 of the bracket hanger device is curved to form a butt portion 70 that is positioned against the rear wall for connection by the screw or fastener 68.

As depicted in FIG. 3 and FIG. 8, this gutter protection system has a sleek and profile unlike the large and bulky product available today and its design is attractive.

Figure 7:
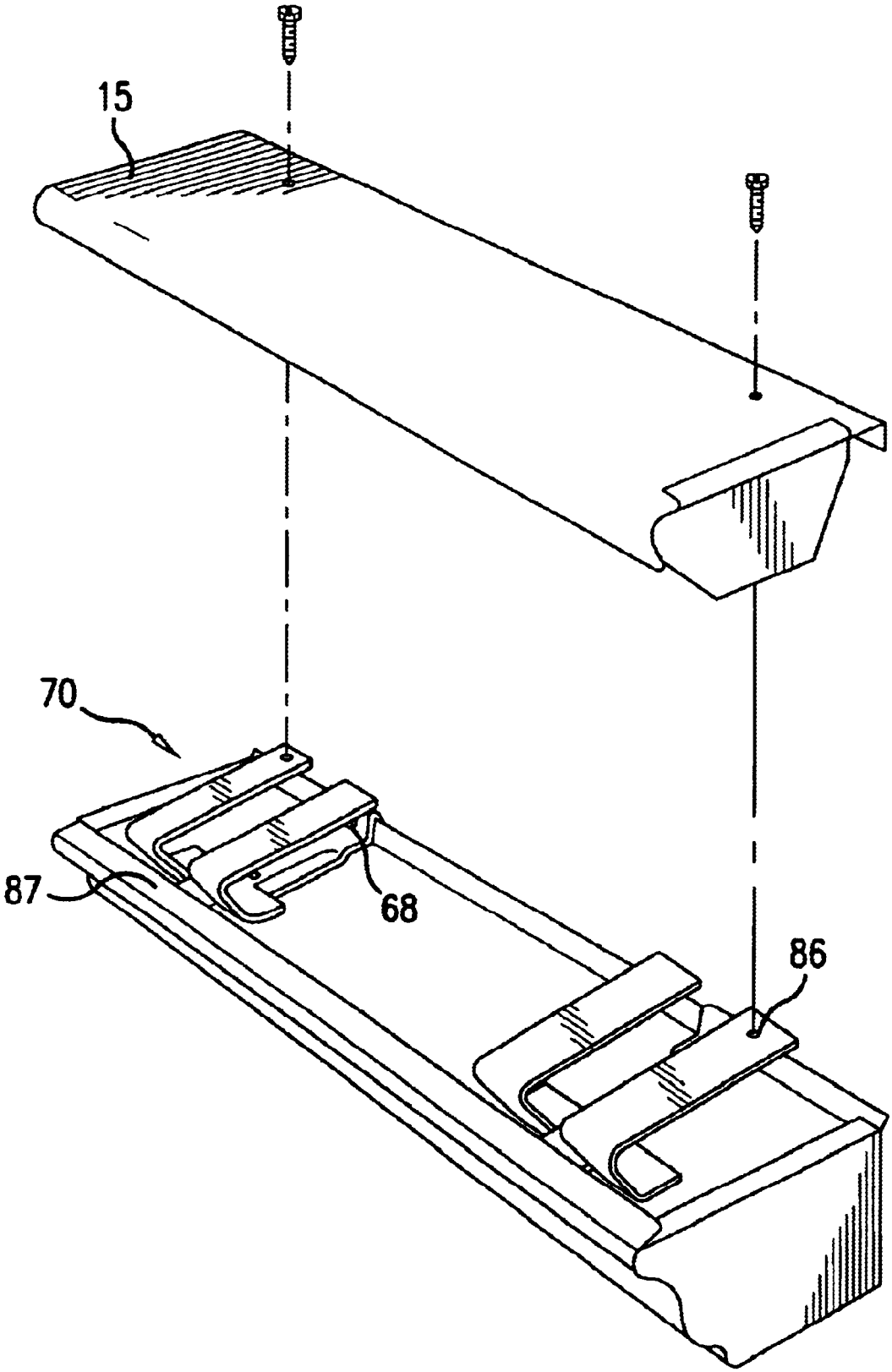
FIG. 7 is an exploded perspective view of an embodiment of the gutter protection system positioned in the gutter.

The bracket-hanger 70 device of the gutter protection system 110 can be installed to a pre-existing gutter system or during the installation of the gutter system on the structure as seen on FIG. 7. FIG. 8 depicts a cross sectional view of the bracket-hanger device 70 sealed in the trough 54 of the gutter body 51.

The steps of installing the gutter protection system 110 of this second embodiment are similar to the steps of that described with the first embodiment except that the bracket-device 70, being integrally formed as a single piece, removes the step of attaching the bracket to the hanger. In order to attach the gutter protection system 110 to an existing gutter system, individual hangers 58 would need to be removed and replaced with the bracket-hanger device 70. The cover member 15 can then be placed on the bracket-hanger device 70 as previously described.

Figure 9:
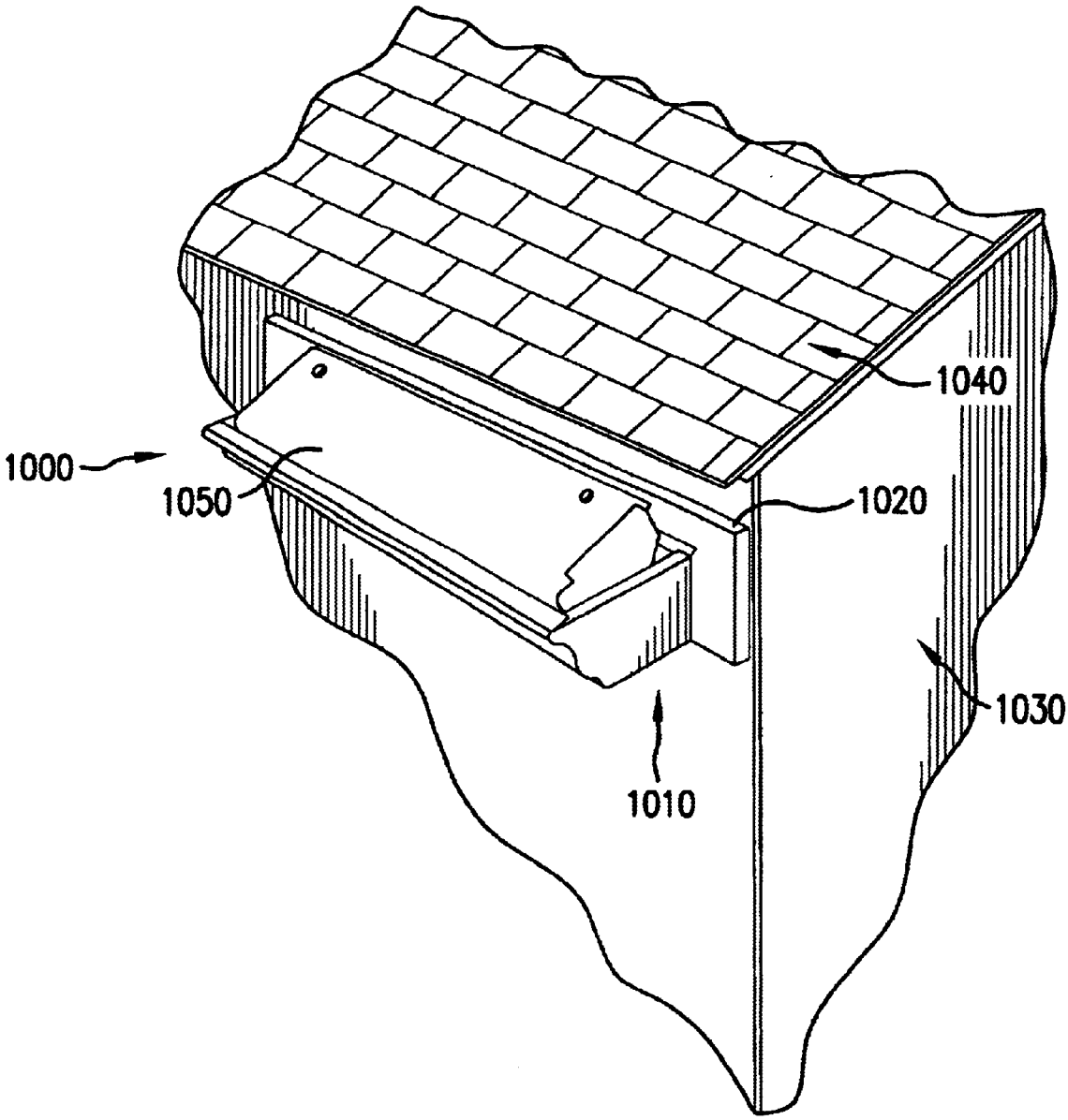
FIG. 9 is a perspective view of an embodiment of a gutter protection system according to the present invention.

FIG. 9 is a perspective view of an embodiment of a gutter protection system 1000, which is shown attached to a gutter 1010, which is attached to a face board or fascia 1020 of a building 1030. Rain that falls on building 1030 encounters roofing 1040, which directs that rain to a top surface of a cap 1050 of gutter protection system 1000, which then directs the rain into gutter 1010. Rain that enters gutter 1010 is then directed to a downspout (not shown).

Figure 10:
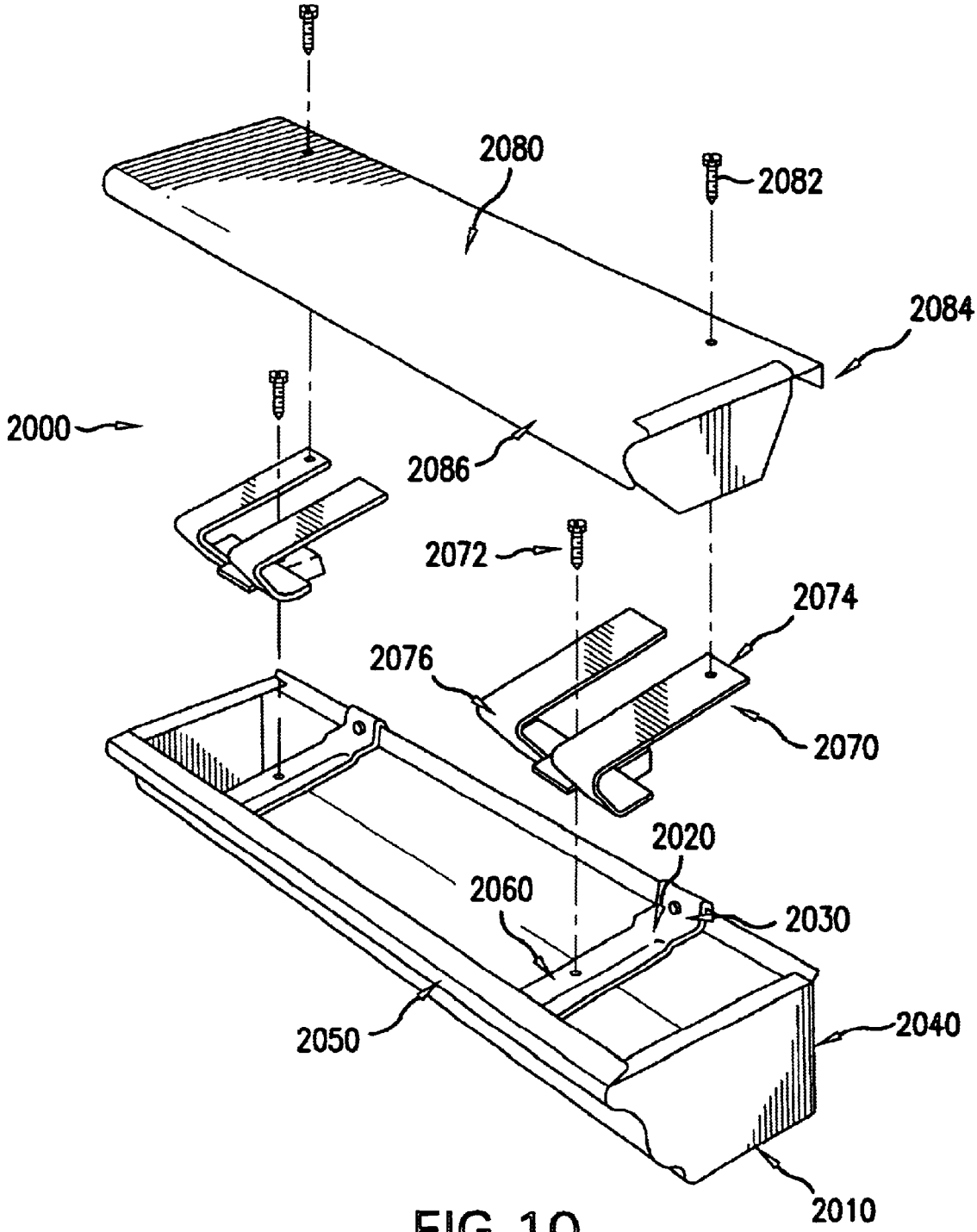
FIG. 10 is an exploded perspective of an embodiment of a gutter protection system.

FIG. 10 is an exploded perspective view of an embodiment of a gutter protection system 2000. A gutter 2010 can be supported by a hanger 2020 that is secured to a building (not shown) by a screw or nail (not shown) that protrudes through securement hole 2030. Hangar 2020 can penetrate a back wall 2040 of gutter 2010, and can support a front lip 2050 of gutter 2010. Because the existence and/or location of hangar 2020 can be undetectable from a viewer standing below, hangar 2020 can be referred to as a "hidden hangar".

Hangar 2020 can define a flat surface 2060 which can support gutter protection system 2000, and to which gutter protection system 2000 can be attached, secured, and/or mounted. Gutter protection system 2000 can include a support bracket 2070 and a cover, deflector, and/or cap 2080. Support bracket 2070 can be configured to mount on hangar 2020. Support bracket 2070 can support cap 2080 at a predetermined and/or adjustable angle with respect to a length of hangar 2020, to back wall 2040, and/or to roofing of the building (not shown).

Support bracket 2070 can be attached, mounted, connected, and/or secured to hangar 2020 by any known attachment means 2072, including a screw, a rivet, a nail, an adhesive, a hook and loop fastener, a buckle, a latch, a force fit, and/or a snap fit. Moreover, support bracket 2070 can be integral to hangar 2020. Support bracket 2070 can be constructed of any material known for its use for gutters, including aluminum, galvanized steel, copper, and/or plastic. Support bracket 2070 can be configured to avoid contact with the fascia, roofing components, and/or structure of the building itself (not shown), thereby avoiding unnecessary installation interferences and/or long-term wear caused by such contact.

Cap 2080 can be attached, mounted, connected, and/or secured to support bracket 2070 by any known attachment means 2082, including a screw, a rivet, a nail, an adhesive, a hook and loop fastener, a buckle, a latch, a force fit, and/or a snap fit. For example, cap 2080 can define a back lip (not shown) that can snap onto a back edge 2076 of support bracket 2070 once a front portion 2084 of cap 2080 has surroundably engaged an arcuate front portion 2074 of support bracket 2070. Moreover, cap 2080 can be integral to support bracket 2070.

Cap 2080 can be constructed of any material known for its use for gutters, including aluminum, galvanized steel, copper, and/or plastic. Also, cap 2080 can be dimensioned and/or configured to avoid contact with the fascia, roofing components, and/or structure of the building itself (not shown), thereby avoiding unnecessary installation interferences and/or long-term wear caused by such contact. Thus, once installed, one or more separations, gaps, and/or spaces can be defined between cap 2080 and the fascia, roofing components, and/or structure of the building.

Embodiments of the gutter protection system of the present invention can provide numerous advantages. For example, in certain of its various embodiments, can be attached to gutter systems either prior to, during, or after installation of those gutter systems. In certain embodiments, this attachment can occur with substantial ease. Moreover, the support member and cover of certain embodiments can be fashioned to accommodate structures and roofs of all types as they do not require connection to the structure or roofing, thereby eliminating potential damage to the structure or roofing. Also, the cover can be positioned at a predetermined and/or adjustable angle to provide a desired pitch of the cover related to the pitch of the roof. Moreover, embodiments of the gutter protection system of the present invention can provide a cost effective product with an aesthetically pleasing appearance. Further, embodiments of the present invention can allow water to enter a gutter system, while reducing, resisting, and/or preventing the entry of debris into the gutter system.

In the drawings and specification, there have been disclosed certain embodiments of the invention and although specific terms are employed, those terms are used in a generic and descriptive sense only and not for purposes of limitation, the scope of the invention being set forth in the following claims.

What is claimed is:

1. A gutter protection system for diverting debris from and collecting water in a gutter having a trough extending along the length of the gutter and the gutter connected with the roofline of a building structure by a gutter hanger connected to a front lip of the gutter and extending transversely across the width of the trough to the structure, the gutter protection system comprising:

a bracket having a seat adapted to be positioned on the hanger and at least one arm extending from the seat, a solid cap connected on the at least one arm of the bracket and extending along the arm in a first direction defining the width of the cap and laterally away from the arm on opposite sides in a second direction defining the length of the cap; and affixing means for affixing the bracket to the hanger, wherein the bracket is adapted to positionally fix the cap above the trough at a predetermined angle of inclination from the gutter such that the cap extends in its first direction above the substantial width of the trough and the cap is spaced apart from the structure.

2. A gutter protection system according to claim 1, wherein said at least one arm further comprises a plurality of spaced apart arms.

3. A gutter protection system according to claim 1, wherein said cap is positionally fixed at a predetermined angle approximating the angle of the roofline of the structure.

4. A gutter protection system according to claim 1, wherein said at least one arm extends from said seat such that said bracket is adapted to be affixed to the hanger with the distal end of the arm spaced apart from the building structure.

5. A gutter protection system according to claim 1, further comprising said arm extending from said seat at a predetermined angle, and wherein said cap is juxtaposed above and coextensively along the length of the at least one arm such that the cap and the arm extend from the base at approximately the same angle of inclination.

6. A gutter protection system according to claim 1, the bracket further comprises at least two later wings extending downwardly on opposite sides of said seat, wherein the bracket is adapted to be positioned on the hanger such that said wings contact opposite sides of the hanger to secure said bracket in a fixed position with respect to the bracket.

7. A gutter protection system according to claim 1, where the bracket further comprises an arcuate body portion between said arms and said seat and the cap further comprises an arcuate lip portion at a forward end of its width, the arcuate lip portion coextensively enveloping the arcuate body portion of the bracket, the arcuate lip portion being configured to utilize the surface tension of rainwater to direct the rainwater along the lip into the trough.

8. A gutter protection system according to claim 1 wherein the bracket and cap are integrally formed in a single piece.

9. A method for retrofitting a gutter protection system for diverting debris from and collecting water into an existing gutter trough, the gutter being connected with the building structure at a roofline with a hanger connected to the front wall of the gutter and extending transversally across the width of the trough and connected through the gutter to the structure, the method comprising:

providing a bracket having a seat and at least one least one arm extending from the seat, connecting a solid cap to the arm of the bracket such that the cap extends along the arm in a first direction defining the width of the cap and laterally away from the arm on opposite sides in a second direction defining the length of the cap, and affixing the bracket on the hanger with affixing means to positionally fix the cap above the trough at a predetermined angle of inclination such that the cap extends in its first direction above the substantial width of the trough and the cap is spaced apart from the roofline of the structure.

10. A method for retrofitting a gutter system according to claim 9, wherein the affixing step further comprises positionally fixing the cap at predetermined angle of inclination approximating the angle of the roofline.

11. A method for retrofitting a gutter system according to claim 9, wherein the affixing step replaces the existing hanger with a bracket-hanger device wherein the hanger and bracket are integrally formed in a device of a unitary construction.

12. A method for attaching a gutter system including a gutter protection system for diverting debris from and collecting water to a structure comprising:

providing a gutter having a trough, extending along the length of the gutter;

connecting a hanger to the gutter and extending transversely across the trough;

fastening the hanger to the gutter and the building structure with fastening means, providing a bracket having a seat and at least one least one arm extending from the seat at an angle from the seat, connecting a solid cap to an arm of the bracket such that the cap extends along the arm in a first direction defining the width of the cap and laterally away from the arm on opposite sides in a second direction defining the length of the cap, and affixing the bracket on the hanger with affixing means to positionally fix the cap above the trough such that the cap extends in its first direction above the substantial width of the trough and the cap is spaced apart from the roofline of the structure.

13. A method for attaching a gutter system according to claim 12, the affixing step further comprising affixing the bracket such that the cap is positionally fixed at an angle approximating the angle of the roofline.

14. A gutter protection system for diverting debris from and collecting water in a gutter having a trough extending along the length of the gutter and the gutter adapted to be connected with the roofline of a building structure by the gutter protection system, the gutter protection system comprising:

a bracket having a seat adapted to be positioned on a gutter hanger and at least one arm extending from the seat, a solid cap connected on the at least one arm of the bracket and extending along the arm in a first direction defining the width of the cap and laterally away from the arm on opposite sides in a second direction defining the length of the cap, said gutter hanger adapted to be connected to a front lip of the gutter and extending transversely across the width of the trough to the structure, wherein the bracket is adapted to positionally fix the cap above the trough at a predetermined angle of inclination such that the cap extends in its first direction above the substantial width of the trough and the cap is spaced apart from the roofline of the structure.

15. A gutter protection system (10) according to claim 14 wherein the bracket and hanger are integrally formed in a single construction as a bracket hanger device.

16. A gutter protection system, comprising:

a bracket having a seat adapted to be positioned on a hanger, the hanger connected to a front lip of a gutter and extending transversely across a width of the gutter, at least one arm extending from the seat, a solid cap connected on the at least one arm of the bracket and extending along the arm in a first direction defining a width of the cap and laterally away from the arm on opposite sides in a second direction defining a length of the cap; and affixing means for affixing the bracket to the hanger, wherein the bracket is adapted to positionally fix the cap above the gutter at a predetermined angle of inclination from the gutter such that the cap extends in its first direction above a substantial width of the gutter and a rearward region of the cap extending in the second direction and adjacent a building is spaced apart from the building and not affixed to a roof of the building.

17. A gutter protection system, comprising:

a bracket having a seat adapted to be positioned on a hanger, the hanger adapted to be connected to a front lip of a gutter and extend transversely across a width of the gutter, at least one arm extending from the seat, the bracket adapted to be affixed to the hanger, a solid cap adapted to be connected on the at least one arm of the bracket and extend along the arm in a first direction defining a width of the cap and laterally away from the arm on opposite sides in a second direction defining a length of the cap; the cap adapted to be positionally fixed at a predetermined angle of inclination from the gutter such that the cap extends in its first direction above a substantial width of the gutter and a rearward region of the cap extends in the second direction and adjacent a building and is spaced apart from the building and not affixed to a roof of the building.

18. A system, comprising:

a gutter;

a hangar connected to a front lip of a gutter and extending transversely across a width of the gutter;

a bracket positioned on the hanger; and a solid cap connected to the bracket, the bracket positionally fixing the cap above the gutter and spaced apart from the gutter and adjacent yet spaced apart from a building and not affixed to a roof of the building.

19. A gutter protection system, comprising:

a bracket adapted to be positioned on a gutter hanger, the gutter hanger connected to a front lip of a gutter and extending transversely across a width of the gutter; and a solid cap adapted to be connected to the bracket, the bracket adapted to positionally fix the cap above the gutter and spaced apart from the gutter and adjacent yet spaced apart from a building and not affixed to a roof of the building.

20. The gutter protection system of claim 19, wherein the bracket is adapted to positionally fix the cap above the gutter at a predetermined angle of inclination.

21. The gutter protection system of claim 19, wherein the bracket is adapted to positionally fix the cap above the gutter at an adjustable angle of inclination.

22. The gutter protection system of claim 19, wherein the bracket is adapted to positionally fix the cap above the gutter at a predetermined and adjustable angle of inclination.

23. The gutter protection system of claim 19, wherein the bracket is adapted to positionally fix the cap above the gutter at a predetermined angle of inclination approximating an angle of inclination of the roof of the building.

24. The gutter protection system of claim 19, wherein the bracket is adapted to positionally fix the cap above a substantial width of the gutter.

25. The gutter protection system of claim 19, wherein the solid cap is adapted to extend along the bracket in a direction parallel the gutter hanger.

26. The gutter protection system of claim 19, wherein the solid cap is adapted to extend laterally away from opposite sides of the bracket in a direction defining a length of the cap.

27. The gutter protection system of claim 19, wherein the solid cap is adapted to snapably attach to the bracket.

28. The gutter protection system of claim 19, wherein the solid cap is integral to the bracket.

29. The gutter protection system of claim 19, wherein the solid cap is adapted to be positioned below a lower edge of the roof of the building.

30. The gutter protection system of claim 19, wherein the solid cap is adapted to direct water into the gutter.

31. The gutter protection system of claim 19, wherein the solid cap is adapted to divert debris from the gutter.

32. The gutter protection system of claim 19, wherein the solid cap is adapted to be solely supported by the bracket.

33. The gutter protection system of claim 19, wherein the bracket is adapted to snapably attach to the hangar.

34. The gutter protection system of claim 19, wherein the bracket is integral to the hanger.

35. The gutter protection system of claim 19, wherein the bracket comprises a seat adapted to be positioned on the hanger.

36. The gutter protection system of claim 19, wherein the bracket comprises a seat adapted to be positioned on the hanger, at least one arm extending from the seat.

37. The gutter protection system of claim 19, wherein the bracket comprises a seat adapted to be positioned on the hanger, at least one arm extending from the seat, the cap adapted to extend along the at least one arm.

38. The gutter protection system of claim 19, wherein the bracket comprises a seat adapted to be positioned on the hanger, two spaced-apart arms extending from the seat.

39. The gutter protection system of claim 19, wherein the bracket comprises a seat adapted to be positioned on the hanger, two spaced-apart arms extending from the seat, the arms adapted to be positioned parallel a length of the hangar.

40. The gutter protection system of claim 19, wherein the bracket comprises at least one arm.

41. The gutter protection system of claim 19, wherein the bracket comprises at least one arm, the cap adapted to extend along the at least one arm.

42. The gutter protection system of claim 19, wherein the bracket comprises two spaced-apart arms.

43. The gutter protection system of claim 19, wherein the bracket comprises two spaced-apart arms, the arms adapted to be positioned parallel a length of the hangar.

44. The gutter protection system of claim 19, wherein the hanger is a hidden hangar.

* * * * *